United States Patent [19]

von Karchowski

[11] Patent Number: 4,533,311

[45] Date of Patent: Aug. 6, 1985

[54] APPARATUS FOR PRODUCING DEEP, CONICAL OR CYLINDRICAL CERAMIC HOLLOW BODIES FROM A POWDERED OR GRANULAR PRESSED MASS BY ISOSTATIC COMPRESSION

[75] Inventor: Wilhelm von Karchowski, Trier, Fed. Rep. of Germany

[73] Assignee: Laeis-Werke AG, Trier, Fed. Rep. of Germany

[21] Appl. No.: 578,572

[22] Filed: Feb. 9, 1984

[30] Foreign Application Priority Data

Feb. 10, 1983 [DE] Fed. Rep. of Germany ..... 3304576

[51] Int. Cl.[3] ..... B30B 5/02; B30B 11/00

[52] U.S. Cl. ..... 425/405 H; 249/58

[58] Field of Search ..... 425/405 H; 249/58

[56] References Cited

U.S. PATENT DOCUMENTS

| | | | |
|---|---|---|---|
| 1,885,303 | 11/1932 | Slick | 249/58 X |
| 2,290,910 | 7/1942 | Jeffery | 425/405 H X |
| 3,477,096 | 11/1969 | Bowles et al. | 425/405 H |
| 3,557,056 | 12/1967 | Reyburn | 249/58 X |
| 3,588,080 | 6/1971 | Wallick | 425/405 H X |
| 3,593,373 | 7/1971 | Loomis | 425/405 H X |
| 3,618,179 | 11/1971 | Anderson et al. | 425/405 H |
| 3,664,799 | 5/1972 | Wallick et al. | 425/405 H X |
| 3,832,100 | 8/1974 | Boxendale | 425/405 H X |
| 4,057,383 | 11/1977 | Bettonica | 425/405 H |
| 4,482,515 | 11/1984 | Bühler et al. | 425/405 H X |

*Primary Examiner*—J. Howard Flint, Jr.

*Attorney, Agent, or Firm*—Spencer & Frank

[57] ABSTRACT

A method and apparatus for the manufacture of deep, conical or cylindrical ceramic hollow bodies made of a powdered or granular pressed mass by isostatic compression, and with projections, such as handles, grips or the like provided on the hollow body being pressed simultaneously with the hollow body. To facilitate introduction of the pressing mass into the press chambers provided in the press mold for both the hollow body and the projection, the pressing mass, in addition to falling freely, is introduced into the respective press chambers under the influence of a vacuum.

14 Claims, 5 Drawing Figures

APPARATUS FOR PRODUCING DEEP, CONICAL OR CYLINDRICAL CERAMIC HOLLOW BODIES FROM A POWDERED OR GRANULAR PRESSED MASS BY ISOSTATIC COMPRESSION

BACKGROUND OF THE INVENTION

The present invention relates to a method and an apparatus for producing deep, conical or cylindrical ceramic hollow bodies of a powdered or granular pressed mass by means of isostatic compression.

A method and an apparatus of the above type are disclosed in Federal Republic of Germany Offenlegungsschrift No. DE-OS 2,657,704, laid open for public inspection on July 14, 1977. To produce hollow truncated cones or cylindrical elements having comparatively thin walls, such as, for example, small coffee cups, a powder or ceramic paste is used as the pressing mass. The described process indicates that only the actual hollow body is pressed according to the isostatic method, and that obviously projections, such as, for example, grips and handles, are produced in further process stages and must subsequently be attached to the pressed hollow body. In the so-called wet method, in which pastes are employed, the shaping of projections, such as grips and handles, is possible but such a manufacturing sequence is very complicated and cost intensive. Moreover, this manner of proceeding is connected with low output and with a high rate of rejects during the manufacturing process.

SUMMARY OF THE INVENTION

It is therefore the object of the present invention to provide a method and an apparatus for manufacturing deep conical or cylindrical ceramic hollow bodies of a powdered or granular pressed mass by means of isostatic compression, wherein the finished product, including any projections, can be manufactured much more speedily and is distinguished by substantially improved quality.

This object is basically accomplished by the present invention in that projections provided on the hollow body, such as handles, grips or the like, are pressed in the same process stage as the hollow body. In this way, a much greater output can be realized, with a lower rate of rejects and finally an end product which is much more true to dimensions. In order to manufacture the end product in one process stage, the pressing mass is introduced into a major press chamber which serves to form the hollow body and is simultaneously introduced into an additional press chamber which is connected with the major press chamber and in which the projection or projections are formed, and the pressing mass is compressed in both of these chambers by isostatic compressive pressure.

In order to facilitate the introduction of the pressing mass into the press chambers, and in particular into the additional press chamber, the pressing mass, which has been dried by atomization, is subjected, in addition to letting it undergo free fall, to the influence of a vacuum. In this way it is assured that the pressing mass completely fills the additional press chamber, which is smaller than the major press chamber, so that it is possible without difficulty to press the projections, for example, a grip or a handle, against the body over its full surface area.

According to a further feature of the invention, it is even possible to set the compressive pressure which is effective in the major press chamber separately from the compressive pressure which is effective in the additional press chamber. In this way it is possible in principle to produce a grip or handle, which is subjected to comparatively great stress, with greater compression than that used for the rest of the body being formed.

Finally, it is also conceivable to make the shape of the major press chamber and/or of the additional press chamber variable, depending on the shape of the hollow body and/or projection(s) to be pressed. Moreover, it is, of course, also possible to produce a plurality of hollow bodies simultaneously in one process phase.

An apparatus according to the present invention for producing deep conical or cylindrical ceramic hollow bodies of powdered or granular pressed masses according to the isostatic compression process comprises a hydraulic press having a machine base, a crosshead, a storage container equipped with a dosaging device for the pressing mass as well as a pressing mold which includes female and male mold portions and a diaphragm, disposed between the mold portions, which can be charged with fluid via a pressure chamber. The pressing mold is provided at one side with a fill opening for the pressing mass or material and this fill opening can be sealed by a pressure piston which is displaceably mounted in a cylindrical body. The pressing mold includes a major press chamber for forming the hollow body and an additional press chamber connected with the major press chamber for forming at least one projection, such as, for example, a handle, grip or the like; the female mold portion is designed to be dividable on a line or surface extending through the additional press chamber for the projection(s); and means are provided for keeping the individual parts of the female mold portion closed and arrested in the pressing position during the pressing process, and, upon completion of the pressing process, for moving the individual parts of the female mold portion apart perpendicularly to the direction of the pressure exerted by the pressure piston.

With such a device it is possible for the first time to produce deep conical or cylindrical ceramic hollow bodies in a dry pressing process according to the principle of isostatic compression, with a grip or handle simultaneously being pressed on.

For a vertical hydraulic press it is advisable to design the pressure piston to serve simultaneously as the control member for a fill channel which feeds the pressing mass to the major and additional press chambers. In this way, the pressure piston performs a dual function, namely firstly to delimit the open side of the female mold side and secondly to close or control, respectively, the fill channel.

In order to assure proper filling of complicated shapes with the pressing mass in the additional press chamber, as required, for example, for handles, it is of advantage for the major and additional press chambers to be connected with a vacuum pump via a channel equipped with a check valve. Thus it is possible to realize, in addition to a free fall of the pressing mass, a vacuum effect which assures that the pressing mass likewise completely fills the generally small additional press chamber.

Construction expenditures of the apparatus are reduced if the pressure piston is designed not only as a control member for the fill channel, but simultaneously also as a control member for the channel which is connected with the vacuum pump. In this way, it is assured that correctly measured portions of the pressing mass are filled in and that a vacuum effect is produced during the filling process which contributes to the desired proper filling and pressing.

Another feature and advantage of the structurally simple device according to the invention is that the fill channel is disposed within the body receiving the pressure piston and is connected, at its inlet opening which faces away from the outlet under control of the pressure piston, with a supporting ring which is displaceable in the direction of pressing. This supporting ring is advisably fastened to a differential ring piston of a hydraulic hollow cylinder disposed concentrically with the pressure piston. The hydraulic hollow cylinder is disposed below the press crosshead between the dosaging member and the body of the pressure piston, and the center portion of the hydraulic hollow cylinder which is in communication with the inlet opening of the fill channel is designed as a fill chute. In this way, additional fill chutes in the form of separate components can be omitted, so that the structure becomes considerably simpler and more economical.

The major press chamber and the additional press chamber may each have their own associated diaphragm and these diaphragms may each be charged via a pressure chamber supplied with its own pressure channels. Such an arrangement is particularly suitable for the production of deep conical ceramic hollow bodies with cast-on handles, such as, for example, coffee cups. For the manufacture of such a product in a single process phase, it is advisable for the additional diaphragm to be designed as a diaphragm tube which forms the pressure chamber and into which opens the associated pressure channel. So as to be able to simultaneously press a handle, the diaphragm tube is placed around a mandrel which, before pressing, is inserted into the female mold in a direction perpendicular to the direction of the pressure applied by the pressing piston, and after pressing is removed again. At its head end, the removable mandrel is profiled to correspond to the free space in the interior of the handle.

It is understood that the male mold as well as possibly the mandrel for forming the handle are designed to be interchangeable so that different inserts, i.e. male mold parts and mandrel parts, can be used depending on the desired end product.

It is of course possible, in order to control all operating processes, to provide a control panel at the hydraulic press which accommodates all switching and operating elements required for start-up, individual and automatic continuous operation of the press.

Other advantages, details and features of the invention will become evident from the description below and from the associated drawings which relate to a preferred embodiment.

DETAILED DESCRIPTION OF THE PREFERRED EMBODIMENTS

Figure 1:
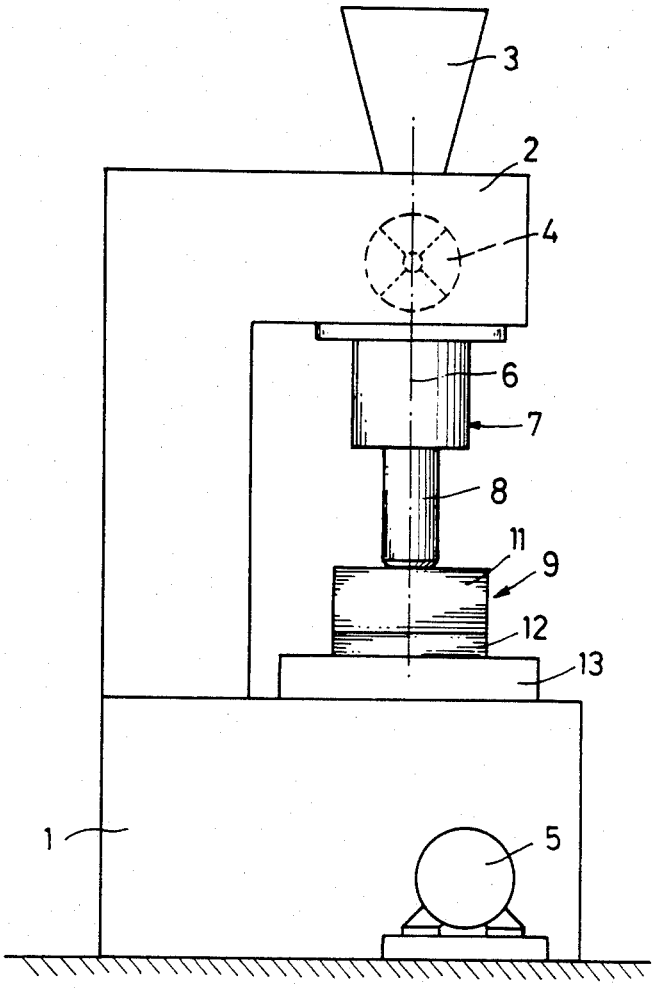
FIG. 1 is a view of a vertical hydraulic press of a generally known design which has been modified to incorporate the device according to the present invention.

The hydraulic press of vertical design shown in FIG. 1 includes a machine base 1 and a press crosshead 2 above which there is a storage container 3 to accommodate a powdered or granular atomization dried pressing mass or material and a dosaging device 4 disposed therebelow in the press cross head 2. Between press crosshead 2 and the machine base 1, in whose vicinity there is also provided a drive assembly 5, there are disposed, concentrically with a vertical axis 6 extending through storage container 3 and dosaging member 4, a hydraulic hollow cylinder 7, a pressing and filling device 8 as well as a press mold 9. The press mold 9 includes an upper portion in the form of a female mold 11 and a lower portion in the form of a male mold 12, the latter being releasably fastened to a bearing plate 13 on the machine base 1.

Figure 2:
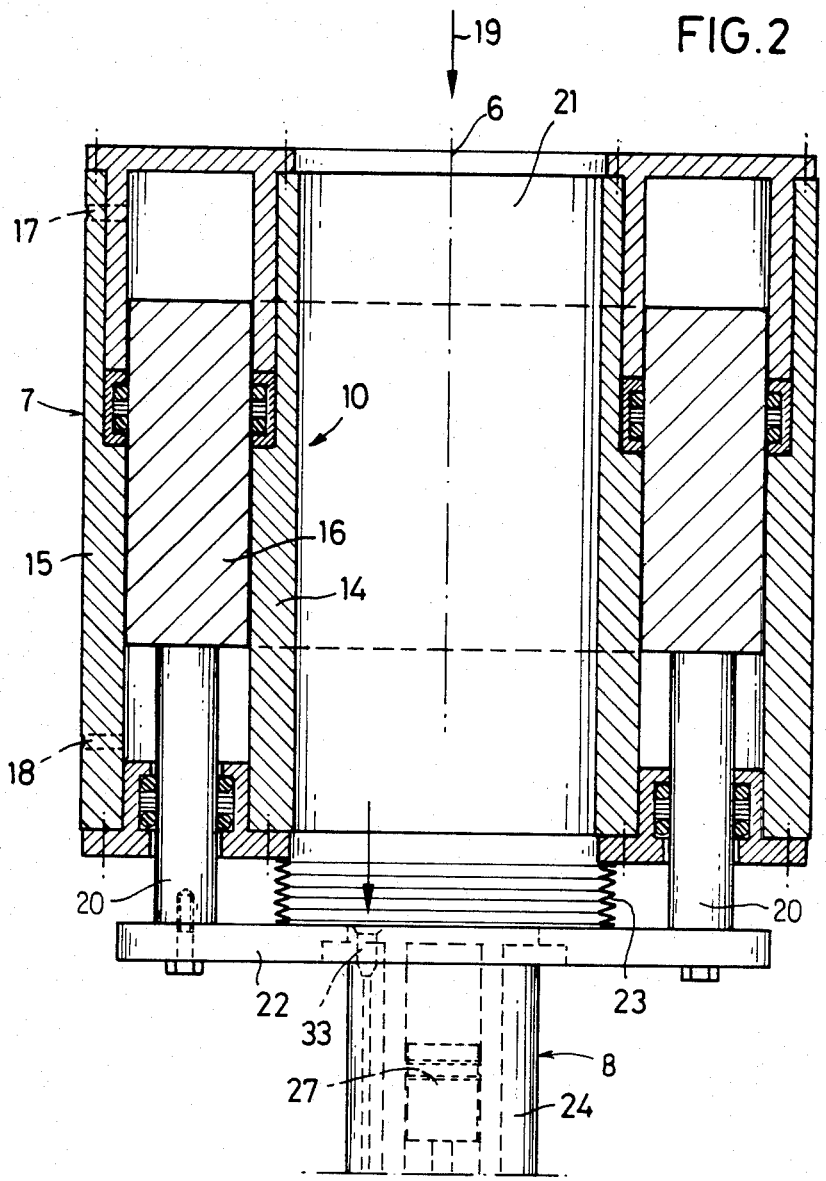
FIG. 2 is a view, partially in cross section, showing the hydraulic hollow cylinder portion of the preferred embodiment of the device according to the invention.

As can be seen in FIG. 2, the hollow cylinder 7, which is arranged concentrically with axis 6, includes two spaced nested steel pipes 14, 15, between which there is disposed a differential ring piston 16 which is vertically movable, by means of pressure fluid supplied and removed respectively via openings 17, 18, in a direction parallel to axis 6 which extends in the pressing direction. Since the hydraulic hollow cylinder 7 is arranged to be concentric with dosaging member 4 and thus the pressing mass drops in a free fall through the inner portion of hollow cylinder 7 in the direction of arrow 19, this portion is designed as a fill chute 21. The hollow cylinder 7 is fastened to the head beam 2 of the press. When charged with pressure via the opening 17, the lower portion of the rods 20 of the differential ring piston 16 exit from the bottom of the sealed hollow cylinder 7. As can also be seen in FIG. 2, the rods 20 of the differential ring piston 16 are connected with a supporting ring 22, with a cylindrical diaphragm 23 being provided as a seal between supporting ring 22 and fill chute 21.

Figure 3:
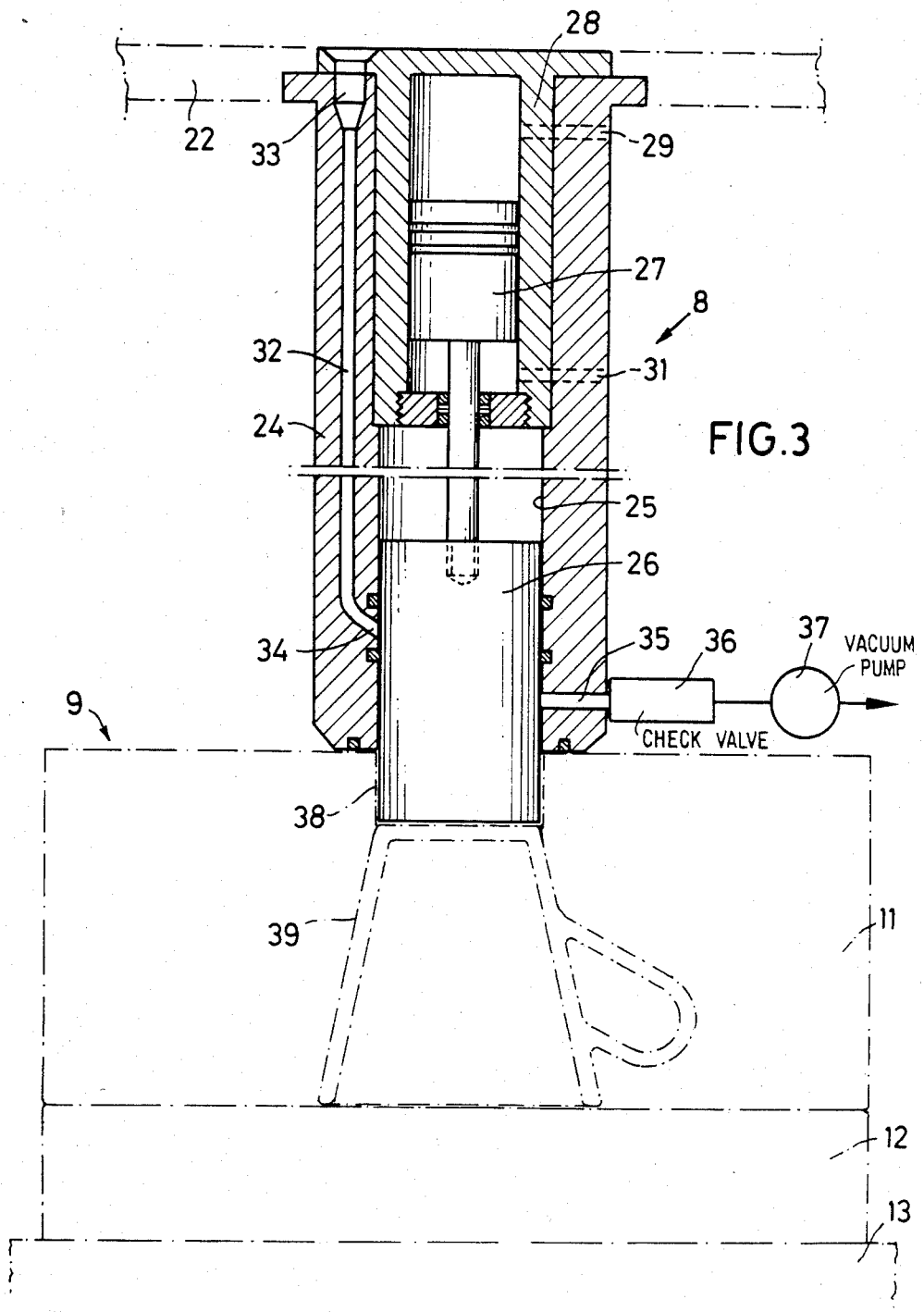
FIG. 3 is a view, partially in cross section, showing the fill portion of the device according to the invention which is arranged between the hydraulic hollow cylinder of FIG. 2 and the actual pressing mold.

As can be seen in part in FIG. 2 and particularly in FIG. 3, supporting ring 22 serves to support the cylindrical body 24, which is part of the filling and pressing device 8 and, when the differential ring piston 16 is lowered, seats itself sealingly on the upper surface of the press mold 9 as indicated in FIG. 3. Cylindrical body 24 has a central bore 25 for displaceably accommodating a pressure piston 26 which is connected with a control piston 27 that is displaceably mounted in a control cylinder 28. Control cylinder 28 can be charged with pressure fluid via pressure connections 29, 31 and thus permits, via control piston 27, vertical displacement of pressure piston 26 in cylindrical body 24. Inside cylindrical body 24 there is a fill channel 32, whose inlet opening 33 is in communication via supporting ring 22 with the fill chute 21 of hydraulic hollow cylnder 7. The lower outlet 34 of fill channel 32 can be sealed by pressure piston 26. A channel 35, which is equipped with an automatic check valve 36 and leads to a vacuum pump 37, is disposed in the cylindrical body 24 at a vertical distance from outlet 34 of fill channel 32 and in the direction toward the press mold 9. Channel 35 leading to the vacuum pump 37 is opened or closed by the controlled upward and downward movement of pressure piston 26, depending on the momentary operating rhythm, thus producing the desired vacuum in press mold 9 during the filling process. After the filling process, the vacuum is removed again.

Pressure piston 26 can be sealingly inserted into an opening 38 of female mold 11 and thus form a counterpiston as required for shaping the bottom of the ceramic hollow body which, in FIG. 3, is indicated by dash-dot lines and marked with the reference numeral 39. After completion of pressing, cylinder 8 and pressure piston 26 move to such a position that the female mold 11 is exposed and the pressed body 39 can be removed either manually or automatically. During this removal time, both channels 32 and 35 are kept closed by the pressure piston 26.

Figure 4:
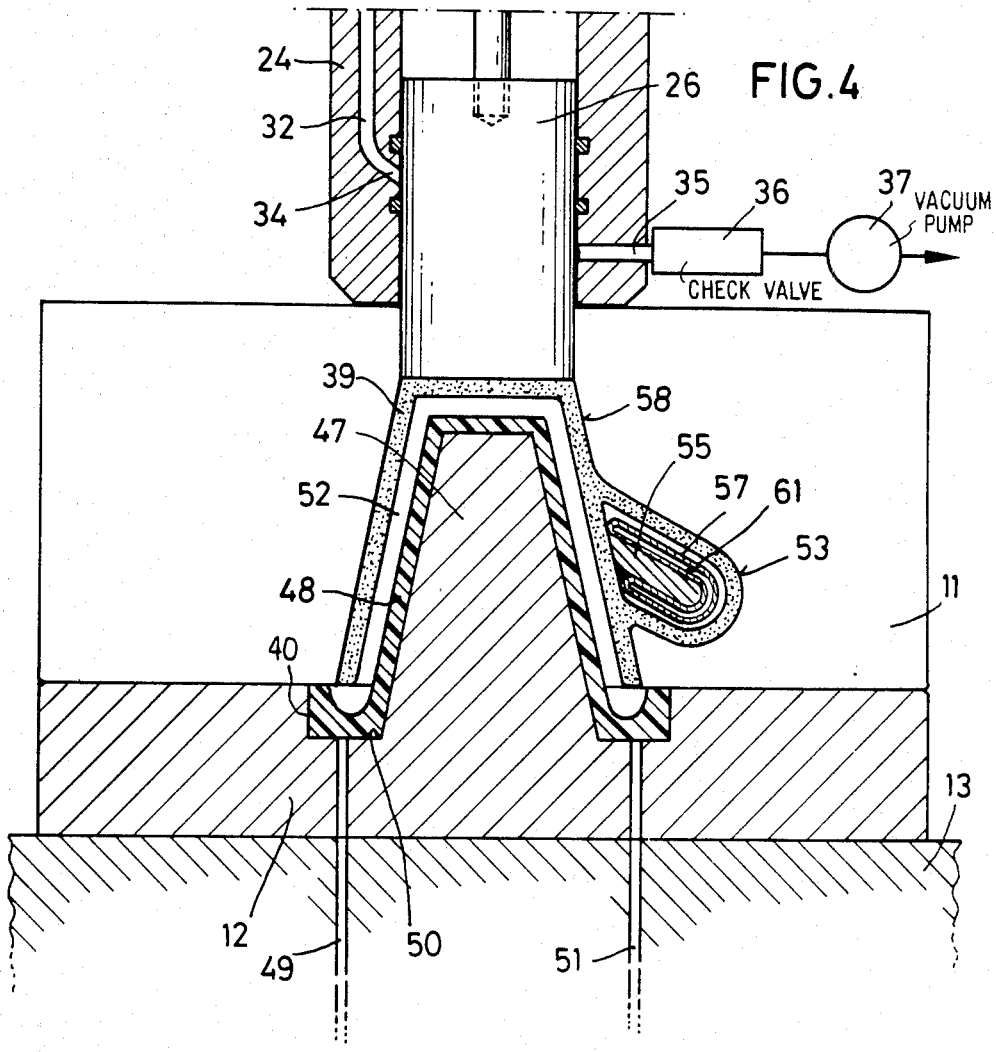
FIG. 4 is a view, partially in cross section and to an enlarged scale, of the pressing mold according to the invention which comprises a stationarily held lower section and a divided upper section.
Figure 5:
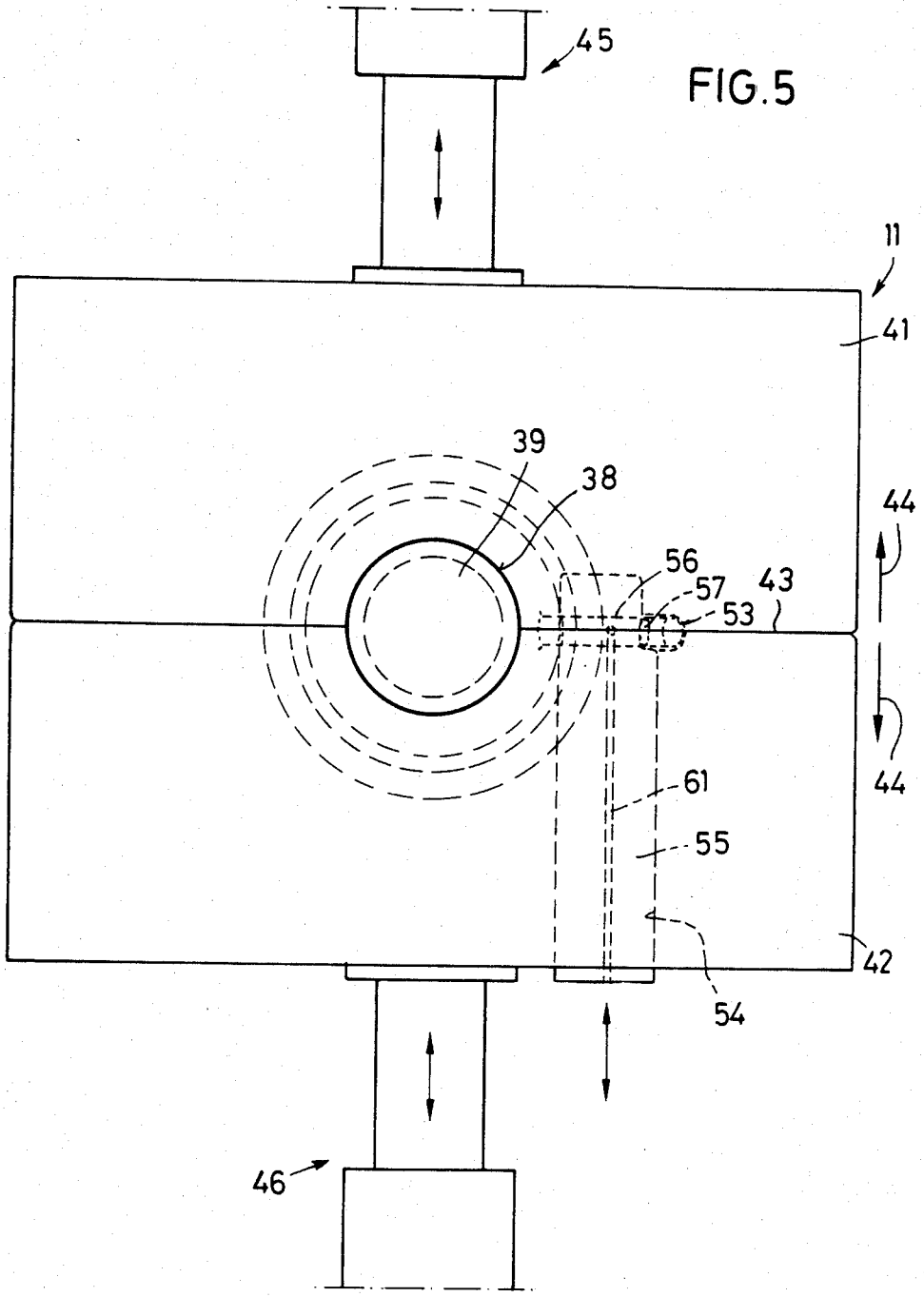
FIG. 5 is a top view of the pressing mold shown in FIG. 4.

FIGS. 4 and 5 show the details of the actual press mold 9. Press mold 9 is essentially rectangular and is designed in three parts, i.e. a male mold 12 and a female mold 11 which has two female mold sections 41 and 42, the parting line or surface between which is marked with the reference numeral 43 in FIG. 5. Female mold sections 41 and 42 can be moved away or toward one another in the indicated directions of arrows 44. Clamping cylinders 45, 46 serve to displace and arrest the female mold sections 41 and 42 in the pressing position.

Male mold 12 which serves as the lower portion of pressing mold 9 is fastened to supporting or bearing plate 13 of machine base 1. The center portion of male mold 12 is provided with a core 47 which is adapted to the shape of the ceramic body to be produced. This core 47 is covered with a double-walled diaphragm 48 which serves as the major diaphragm and which is sealingly fastened to the base of core 47 only at its lower outer circular face 40. Pressure channels 49, 51 lead through male mold 12 and open underneath the wall of diaphragm 48 to supply it with pressurized oil depending on the operating phase presently being performed and to press it away from core 47 and thus form an expanding pressure chamber 50 which causes isostatic compression of the pressing material introduced into the major press chamber 52. Upon completion of the pressing process, the pressurized oil is discharged again so that diaphragm 48 relaxes and returns to its starting position as shown in FIG. 4.

To simultaneously press a projection, e.g. a handle, an additional press chamber 53 is provided in female mold 11. A hydraulically displaceable mandrel 55 is inserted from the side through an offset bore 54 in the two female mold sections 41 and 42 into the additional press chamber 53, and, in effect forms the male mold portion for this press chamber 53. In the region of the handle to be shaped, i.e. in its head region, mandrel 55 is provided with a profiled section 56 which is adapted to the shape of the free space within the handle of the pressed body. Around this profiled section 56 there is provided a diaphragm tube 57 which is closed on all sides and which, once mandrel 55 has been inserted fully into bore 54, rests with both its ends against the outer contour 58 of the conical wall of major press chamber 52. The additional pressure chamber formed by the diaphragm tube 57 itself is also supplied with pressurized oil via a separate channel 61 in the same manner as pressure chamber 50 formed by core 47 and major diaphragm 48 so that diaphragm tube 57 expands and thus isostatically presses the handle, together, i.e. simultaneously, with the isostatic compression of the hollow body itself.

The apparatus according to the present invention opreates as follows:

The dry granular pressing material inserted into storage vessel 3 is supplied in charges through fill chute 21 of hydraulic hollow cylinder 7 to the cylindrical body 24, and particularly its fill channel 32 disposed below hydraulic hollow cylinder 7. The pressing mass then travels downward to outlet 34 which, in the rest state of the press, is kept closed by pressure piston 26.

The press mold 9 is closed, i.e. the two female mold sections 41 and 42 are moved toward one another by the two hydraulic clamping cylinders 45, 46 and are arrested in this position. Mandrel 55 is inserted into bore 54 of female mold 11.

The operating sequence, here explained exemplarily for individual operation, is initiated by the actuation of a pressure key at a switching panel (not shown). Actuated by this pulse, the differential piston 16 is actuated to lower the cylinder 7 to cause its lower end to sealingly engage the upper surface of the mold 9, and thereafter pressure piston 26 is raised to the extent that it initially opens only channel 35 which is in communication with vacuum pump 37. At the same time, the automatic check valve 36 installed in this channel opens so that vacuum pump 37 can extract the air from the closed and sealed interior of the mold 9 until a certain vacuum pressure has been reached. Then check valve 36 is closed again.

Thereafter, pressure piston 26 is raised further until outlet 34 of fill channel 32 is opened. The pressing material now flowing out of outlet 34 is sucked by the vacuum in the interior of the press mold 9, in addition to the force of its free fall, into the major press chamber 52 and into the additional press chamber 53, so that both press chambers are filled simultaneously. Then pressure piston 26 is moved downwardly and thus enters the upper opening 38 of press mold 9 so that, as the counterpiston for pressing the bottom of the hollow body, here, for example, the bottom of a cup, it takes on the required height position.

Pressurized oil is now introduced through channels 49, 51 and 61 so that the primary diaphragm 48 and diaphragm tube 57 are charged and expanded, thus performing the isostatic pressing process on the pressing material in the press chambers 52 and 53, respectively. The magnitude of the pressure and the duration of the process can be regulated by means of suitable devices, such as push-botton switches, time relays, etc. which per se are known to those skilled in the art.

Upon completion of the pressing process, pressure piston 26 is pulled back into its starting position, mandrel 55 is returned to its starting retracted position and the two hydraulic clamping cylinders 45, 46 are switched to retract. The latter thus pull apart the two female mold sections 41 and 42 so that the pressed body is exposed for removal. The primary diaphragm 48 and the diaphragm tube 57 are now also without pressure again, i.e. they return to their starting positions.

It is understood that the present invention is not limited to the illustrated embodiment but instead permits modifications within the scope of the claims. For example, other deep conical or cylindrical ceramic hollow bodies may of course also be formed, where the projection is not a handle but is designed in some other manner. It is also possible to press hollow bodies having a plurality of projections or handles simultaneously with the hollow body if the press mold is correspondingly designed in multiple parts.

It will be understood that the above description of the present invention is susceptible to various modifications, changes and adaptations, and the same are intended to be comprehended within the meaning and range of equivalents of the appended claims.

What is claimed is:

1. Apparatus for producing deep conical or cylindrical ceramic hollow bodies from a powdered or granular pressing material according to an isostatic compression process, said apparatus comprising, in combination: a hydraulic press including a machine base, a crosshead supported on and vertically disposed above said base; a storage container, including a dosaging member for the pressing mass, mounted on said crosshead; a pressure piston displacably mounted in a cylindrical body suspended from said crosshead; and a pressing mold mounted on said base beneath said cylindrical body, and including female and male mold portions, said female mold portion having a fill opening for the pressing mass in its upper surface with said fill opening being sealable by said pressure piston when it is lowered; said male and female mold portions defining, within said pressing mold, a major press chamber for forming a hollow body and an additional press chamber for forming at least one projection on said hollow body, with said additional pressure chamber being connected with said major press chamber, said female mold portion being divided into a plurality of sections along at least one parting surface extending through said additional press chamber for said at least one projection; means for maintaining said female mold sections in a closed position to form said press chambers during the pressing process and for moving said female mold sections apart in a direction perpendicular to the direction of movement of said pressure piston at the end of a pressing process; and isostatic pressure means, including at least one diaphragm which is disposed in said press chambers between said male and female mold portions to define a pressure chamber which is chargeable with a pressurized fluid, for compressing pressing material in said press chambers during the pressing process.

2. Apparatus as defined in claim 1 further comprising a fill channel for supplying the pressing material to said major and additional press chambers via said fill opening; and wherein said pressure piston simultaneously serves as a control member for said fill channel.

3. Apparatus as defined in claim 2 wherein said major and said additional press chambers are connected with a vacuum pump via a further channel provided with a check valve.

4. Apparatus as defined in claim 3, wherein said pressure piston simultaneously serves as a control member for said further channel connected with said vacuum pump.

5. Apparatus as defined in claim 4 wherein said fill channel and said further channel both open into the cylinder for said pressure piston, with the opening for said further channel being vertically displaced from the opening for said fill channel in the direction toward said fill opening.

6. Apparatus as defined in claim 2 wherein: said fill channel is disposed within the wall of said cylindrical body accommodating said pressure piston with its outlet being disposed in the inner surface of said cylindrical body, whereby it is controlled by the movement of said pressure piston, and with its inlet disposed in a supporting ring for said cylindrical body; and, means are provided for mounting said supporting ring for displacement in the direction of movement of said pressure piston.

7. Apparatus as defined in claim 6 wherein: said means for mounting said supporting ring includes a hydraulic hollow cylinder having a differential ring piston mounted therein and fastened to said supporting ring; said hydraulic hollow cylinder is arranged concentrically with said pressure piston and is disposed below said crosshead between said dosaging member and said cylindrical body for said pressure piston; and the hollow center portion of said hydraulic hollow cylinder is in communciation with said inlet of said fill channel and is designed as a fill chute.

8. Apparatus as defined in claim 1 wherein said major press chamber and said additional press chamber are each provided with a respective said diaphragm which defines a respective said pressure chamber.

9. Apparatus as defined in claim 8 further comprising separate pressure channels for separately charging the pressure chamber associated with said major press chamber and the pressure chamber associated with said additional press chamber with pressure fluid.

10. Apparatus as defined in claim 8 wherein: the projection to be formed is a handle; the said diaphragm for said additional press chamber is a closed diaphragm tube which forms the said pressure chamber for said additional press chamber, and into which opens an associated pressure channel for pressurized fluid; the male mold portion for said additional press chamber comprises a mandrel having a head portion which is profiled to correspond to the free space in the interior of the handle and around which said closed diaphragm tube is disposed; said female mold portion has a bore which extends in the direction perpendicular to the direction of movement of said pressure piston and through said additional press chamber in said female mold portion; and said mandrel is disposed in said bore with its said head portion in said additional press chamber during a pressing process, whereby the handle can be pressed around said head portion simultaneously with the pressing of the hollow body.

11. Apparatus as defined in claim 1 wherein said male mold portion is releasably fastened to said machine base.

12. Apparatus as defined in claim 11 wherein the male mold portion for said major press chamber and said mandrel for forming the handle are designed to be exchangeable.

13. Apparatus as defined in claim 1 wherein said means for maintaining said female mold sections includes hydraulic clamping cylinders.

14. Apparatus as defined in claim 1 wherein said hydraulic press includes means for simultaneously pressing a plurality of hollow cylinders having pressed-on projections.

* * * * *